US006350006B1

(12) United States Patent
Muller et al.

(10) Patent No.: US 6,350,006 B1
(45) Date of Patent: Feb. 26, 2002

(54) OPTICAL INK DROP DETECTION APPARATUS AND METHOD FOR MONITORING OPERATION OF AN INK JET PRINTHEAD

(75) Inventors: Arno Muller, Westport, CT (US); Eswaran C. N. Nambudiri, Ryebrook, NY (US); Peter A. Pagliaro, West Haven, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/193,607

(22) Filed: Nov. 17, 1998

(51) Int. Cl.[7] ..... B41J 29/393
(52) U.S. Cl. ..... 347/19
(58) Field of Search ..... 347/19, 23; 250/573

(56) References Cited

U.S. PATENT DOCUMENTS

| | | | | |
|---|---|---|---|---|
| 4,241,406 A | | 12/1980 | Kennedy et al. | 364/518 |
| 4,648,048 A | | 3/1987 | Dorn et al. | 364/526 |
| 4,900,941 A | | 2/1990 | Barton et al. | 250/566 |
| 4,907,013 A | | 3/1990 | Hubbard et al. | 346/1.1 |
| 5,038,208 A | | 8/1991 | Ichikawa et al. | 358/75 IJ |
| 5,128,691 A | | 7/1992 | Millet et al. | 346/1.1 |
| 5,224,421 A | | 7/1993 | Doherty | 101/211 |
| 5,289,208 A | | 2/1994 | Haselby | 346/140 R |
| 5,321,436 A | | 6/1994 | Herbert | 346/140 R |
| 5,430,306 A | * | 7/1995 | Ix | 347/19 |
| 5,473,351 A | | 12/1995 | Helterline et al. | 347/19 |
| 5,495,103 A | | 2/1996 | Utiger et al. | 250/222.1 |
| 5,559,339 A | * | 9/1996 | Domanik et al. | 250/573 |
| 5,587,728 A | | 12/1996 | Edgar | 347/19 |
| 5,596,353 A | | 1/1997 | Takada et al. | 347/19 |
| 5,650,804 A | | 7/1997 | Kawamura et al. | 347/19 |
| 5,760,799 A | | 6/1998 | Inui et al. | 347/14 |
| 5,764,251 A | | 6/1998 | Hashimoto et al. | 347/16 |
| 5,771,051 A | | 6/1998 | Guenther et al. | 347/19 |
| 5,781,204 A | | 7/1998 | Kanematsu et al. | 347/17 |
| 5,798,772 A | | 8/1998 | Tachihara et al. | 347/11 |
| 5,933,179 A | | 8/1999 | Fogle et al. | 347/188 |
| 5,956,051 A | * | 9/1999 | Davies et al. | 347/19 |
| 6,137,570 A | * | 10/2000 | Chuang et al. | 250/559.04 |

FOREIGN PATENT DOCUMENTS

| | | | |
|---|---|---|---|
| EP | 0872354 A2 | 10/1994 | B41J/19/20 |
| EP | 0702334 A1 | 8/1995 | G07B/17/02 |
| EP | 0702335 A1 | 8/1995 | G07B/17/02 |
| EP | 0714777 A1 | 11/1995 | B41J/2/165 |
| EP | 0714777 B1 | 11/1995 | B41J/2/165 |
| EP | 0747224 A1 | 5/1996 | B41J/2/21 |

* cited by examiner

*Primary Examiner*—John Barlow
*Assistant Examiner*—Julian D. Huffman
(74) *Attorney, Agent, or Firm*—Angelo N. Chaclas; Michael E. Melton

(57) ABSTRACT

An apparatus and method for monitoring operation of an ink jet printhead. An ink jet printer is controlled to eject a periodic sequence of ink jet curtains through an illuminated gap. Variations in the intensity of the illumination caused by the ink jet curtains are detected to generate a signal representative of the opaqueness of the curtains. The signal is compared to a reference and if insufficient opaqueness is detected a poor print quality signal is generated. In one embodiment a feedback loop is established during a calibration mode to adjust the nominal level of illumination.

32 Claims, 5 Drawing Sheets

OPTICAL INK DROP DETECTION APPARATUS AND METHOD FOR MONITORING OPERATION OF AN INK JET PRINTHEAD

CROSS REFERENCE TO RELATED APPLICATIONS

This application is related to the following co-pending applications filed on even date herewith and assigned to the assignee of this application: U.S. Pat. No. 6,276,770, entitled MAILING MACHINE INCLUDING INK JET PRINTING HAVING PRINT HEAD MALFUNCTION; U.S. patent application Ser. No. 909/193,609, entitled APPARATUS AND METHOD FOR REAL-TIME MEASUREMENT OF DIGITAL PRINT QUALITY; and U.S. patent application Ser. No. 09/193,608, entitled APPARATUS AND METHOD FOR REAL-TIME MEASUREMENT OF DIGITAL PRINT QUALITY; all of which are specifically incorporated herein by reference.

BACKGROUND OF THE INVENTION

The subject invention relates to ink jet printing. (As used herein, the term "ink jet "Sprinting" refers to any form of printing wherein print control signals control a print mechanism to eject ink drops to produce a matrix of pixels, i.e. picture elements, having two or more intensity values to represent an image.) More particularly it relates to apparatus and methods for monitoring the operation of an ink jet printhead.

Low cost, widely available ink jet printing technologies such as bubble jet, and piezoelectric ink jet printing have enabled many new applications where dynamically varying information must be transmitted in printed form. Many of these applications rely upon a consistent level of print quality over time since the failure to capture the unique information on even a single document can have serious consequences.

A particular example of an application of ink jet printing where a consistent level of print quality is very important is the use of digital print mechanisms in postage meters and mailing machines. As is well known such devices print postal indicia on mailpieces as proof of the payment of postage. Upon payment to a proper authority such meters or machines are "charged" with a representation of an equivalent amount of funds. As postal indicia are printed the funds in the meter are debited accordingly until exhausted. Since postal services accept indicia printed by postage meters or mailing machines as conclusive proof of payment of the amount of postage indicated such devices are in effect machines for printing money. As a result postal services have imposed high standards both on the print quality of indicia produced by such machines, and on the design of the machines themselves to assure that the appropriate amount is debited from the amount charged into the machine for each indicia printed.

Low cost ink jet printing technologies have greatly simplified and improved the design of postage meters and mailing machines in many respects. Prior postage meters and mailing machines relied upon impact printing techniques which required complicated and expensive mechanisms to print varying postage amounts, which can now be printed in a simple, conventional manner with ink jet print mechanisms. More importantly, ink jet print mechanisms can be easily programmed to print other information such as security codes or addressing or tracking information with the postal indicia to facilitate automated mail handling. However such low cost ink jet print mechanisms can not easily provide consistent print quality as their mechanisms tend to degrade over time as ink dries up, small print nozzles clog or one or more of a number of small, rapidly cycling print elements fails. Such failure can cause substantial losses to a mailer since a large number of mail pieces of substandard print quality may be rejected by a postal service after the cost of the postage has been debited from the prepaid amount charged to the machine.

U.S. Pat. No. 4,907,013; to: Hubbard et al.; issued: Mar. 6, 1990 is believed to be the prior art closest to the subject invention and relates to circuitry for detecting failure of one or more nozzles in an ink jet printhead. In Hubbard et al. a line containing one dot printed by each nozzle in the printhead is scanned to detect the possible absence of a dot. The line can form either a test pattern run before the start of a printing operation or can be incorporated into the image to be printed.

U.S. Pat. No. 5,038,208; to; Ichikawa et al.; issued: Aug. 6, 1991 teaches an ink jet printer which stores the image forming characteristics of an ink jet printhead and which corrects the image forming signals in accordance with the stored characteristics to maintain uniform print density.

U.S. Pat. No. 5,126,691; to: Millet et al.; issued: Jul. 7, 1992 is similar to Hubbard et al. in that it teaches a method for monitoring print quality by the use of a specially printed control frame.

U.S. Pat. No. 5,321,436; to: Herbert; issued Jun. 14, 1994 teaches a postage meter in which the operation of an ink jet printhead is checked by printing a predetermined bar code and then scanning the bar code to determine if it was correctly printed.

U.S. Pat. No. 5,473,351; to: Heterline et al. teaches a method and apparatus for monitoring print density by measuring printed line width and modifying the energy of the pulses applied to each ink jet nozzle to correct the line width.

Commonly assigned U.S. patent application, Ser. No. 09/046,902; titled: Mailing Machine Including the Prevention of Loss of Funds; filed Mar. 24th 1998, which is hereby incorporated by reference, teaches a postage meter or mailing machine having a capability for generating a test pattern; where the test pattern includes pseudo-random information unknown to an operator. Failure of the operator to correctly input the information causes the postage meter to be disabled; and correct input of the information enables the postage meter to continue operation.

While perhaps suitable for their intended purpose the print quality monitoring and control techniques found in the prior art did not provide a simple and inexpensive way to directly monitor operation of ink jet printheads. In general the prior art require expensive apparatus for sensing and measuring specially selected print patterns, together with complicated control of the printhead drive signals.

Thus it is an object of the invention to provide an improved apparatus and method for monitoring operation of an ink jet printhead so that prompt corrective actions can be taken.

BRIEF SUMMARY OF THE INVENTION

The above object is achieved and the disadvantages of the prior art are overcome in accordance with the subject invention by means of an apparatus and method for monitoring operation of an ink jet printing mechanism which include providing predetermined control signals to the ink jet printing mechanism, the printing mechanism responding to the control signals to eject a curtain of ink drops through a predetermined gap; a source of illumination projecting a beam through the gap at substantially a right angle to the path of the curtain, whereby the intensity of the beam downstream from the gap is reduced proportionally to the curtain's optical density. The beam is sensed downstream from the gap to generate an optical density signal representative of variation in intensity of the beam, whereby the optical density signal is representative of the optical density of the curtain; the optical density signal is compared to a first reference signal; and, if the comparison indicates that the curtain is insufficiently dense, a printhead malfunction signal is generated.

In accordance with an aspect of the subject invention, the printing mechanism is comprised in a postage metering system and is further controlled to print postal indicia.

In accordance with another aspect of the subject invention, the postage metering system is responsive to the printhead malfunction signal to inhibit further printing of postal indicia.

In accordance with another aspect of the subject invention, the curtain is oriented so that its long axis is at approximately a right angle to the beam.

In accordance with another aspect of the subject invention, the beam is optically altered to form a collimated beam in the gap and focused onto an aperture of a photosensor to generate the signal.

In accordance with another aspect of the subject invention, the gap is substantially surrounded with a transparent dust ring having openings for entry and exit of the curtain, the beam passing through the dust ring as it enters and exits the gap.

In accordance with a related aspect of the subject invention, the surface of the dust ring is shaped to carry out the optical altering and focusing steps.

In accordance with another aspect of the subject invention, the curtain is oriented with respect to the beam so that a foreshortened projection of the curtain substantially coincides with an aperture of the photosensor.

In accordance with another aspect of the subject invention, the beam is masked so that the masked beam substantially coincides with an aperture of the photosensor.

In accordance with another aspect of the subject invention, the curtain is oriented so that its long axis is approximately parallel to the beam.

In accordance with another aspect of the subject invention, during a calibration period, in which no curtains pass through the gap, the beam's intensity is electronically varied to artificially generate the optical density signal; and the optical density signal is fed back to the illumination source to control the beam's nominal intensity; so that the nominal intensity is varied to compensate for variations in overall sensitivity.

In accordance with a related aspect of the subject invention, during measuring periods in which the curtains pass through the gap, the nominal intensity is fixed.

Other objects and advantages of the subject invention will be apparent to those skilled in the art from consideration of the detailed description set forth below and the attached drawings.

DETAILED DESCRIPTION OF PREFERRED EMBODIMENTS OF THE INVENTION

Figure 1:
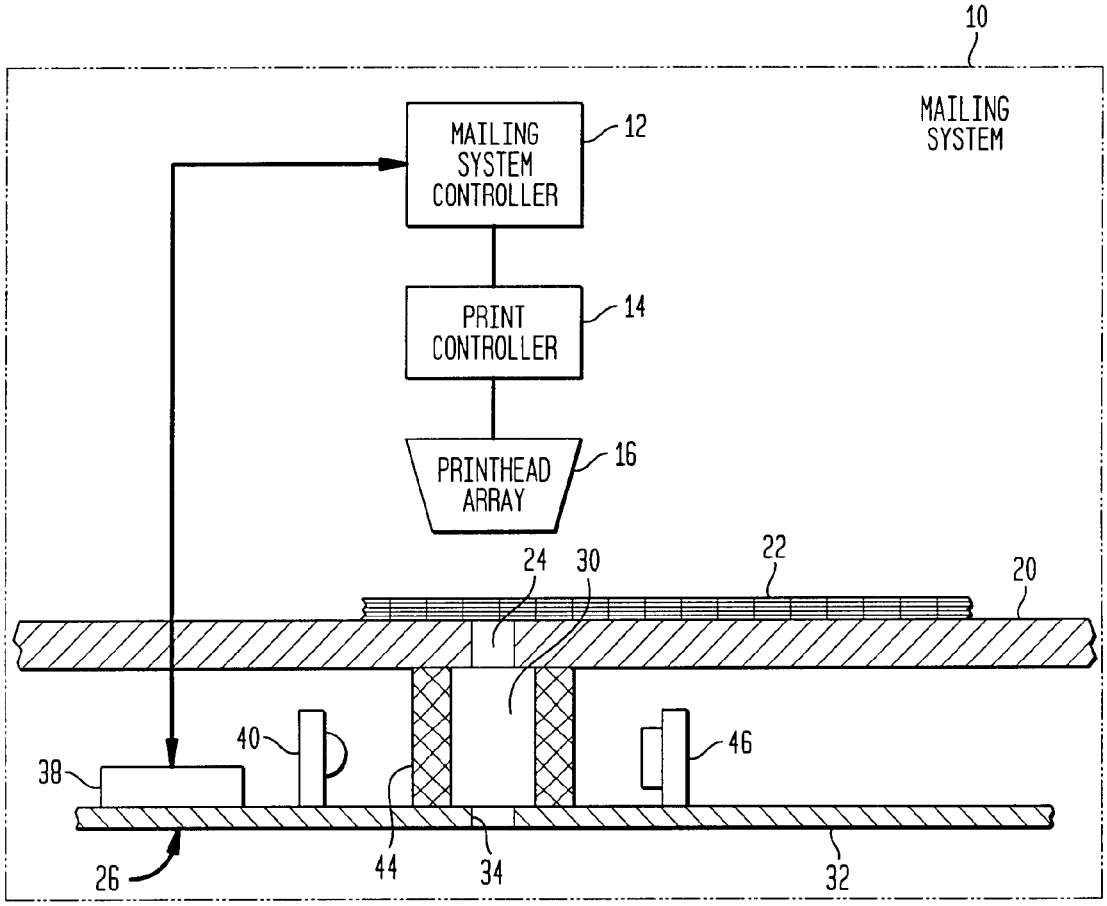
FIG. 1 is a schematic block diagram of a mailing system having an ink jet printing mechanism and including an apparatus in accordance with the subject invention for monitoring of printhead operation.

FIG. 1 shows a simplified block diagram of a conventional mailing system 10, which can be a postage meter or mailing machine or other known apparatus for the preparation of mail which include a postage metering function and which digitally prints postal indicia. System 10 includes controller 12 for controlling postage meter functions, such as accounting of for postage expended, in a conventional manner well known to those skilled in the art. Controller 12 responds to appropriate inputs to determine the variable content of a postal indicia such as postal amount, the date, or variable encrypted information. Controller 12 then controls a printing mechanism comprising print controller 14 and ink jet printhead array 16 to print an indicia (not shown) on substrate 22.

In accordance with the subject invention controller 12 also controls the print mechanism to eject an ink jet curtain at a time when no substrate is present. The curtain passes through deck 20 through opening 24 and is detected by apparatus 26 which is mounted below and proximate to deck 20. (As used herein the terms "ink jet curtain" or "curtain" refer to a substantially continuous row of ink drops formed when all nozzles of a printhead are fired substantially simultaneously. Insufficient optical density of such a curtain indicates failure of one or more printhead nozzles.) The curtain passes through gap 30 between deck 20 and printed wire board 32 ( hereinafter PWB 32) and exits through opening 34 in PWB 32 and is collected in any convenient manner (not shown).

Apparatus 26 includes control electronics 38 which communicate with system controller 12, illumination source 40, transparent dust ring 44 substantially surrounding gap 30, and photosensor 46 for sensing light which is projected through gap 30 from source 40. Electronics 38, source 40 and photosensor 46 are interconnected by PWB 32. Preferably PWB 32 and deck 20 include mating fixtures to assure that apparatus 26 is properly aligned with opening 24. In a preferred embodiment of the subject Invention illumination source 40 is a light emitting diode (hereinafter "LED") which emits light with a spectrum selected to correspond to the light absorption spectrum of the ink emitted by printhead array 16. (If the ink absorption spectrum has plural peaks the longest wavelength is selected because the corresponding LED the corresponding LED has a greater range of brightness and because the photosensor is more sensitive to longer wavelengths.)

(It should be noted that printhead array 16 has been shown as fixed for simplicity of illustration and that printing and monitoring functions have been assumed to be carried out at the same location. However, in other embodiments printhead array 16 is moveable and apparatus 26 can be located at any convenient point along deck 20.)

Photosensors suitable for use as photosensor 46 are currently available in essentially three types:

1. Phototransistors (low speed; simple, inexpensive)
2. PIN type photodiodes (medium speed), and
3. PIN type photodiodes (high speed; requires complex, low noise circuitry to use)

Because the ink drops fall rapidly (approximately 6 meters/ second) the slower reaction time of phototransistors limits their suitability. The ink jet curtain must be relatively long to compensate for the slow reaction time. While feasible, such embodiments have a high ink consumption and the lowest ability to detect marginal failures of printheads. However it is believed that the phototransistor can be used in embodiments, described further below, where the curtain is illuminated along its longitudinal axis.

In other, preferred embodiments, also described below, a series of short curtains, spaced with approximately a fifty percent duty cycle, is used in place of a single long curtain. In these embodiments the output of photosensor 46 can be AC coupled and, if necessary, pass band filtered to improve signal to noise ratio. These embodiments require the use of photodiodes. The higher response rates of photodiodes allows discrimination of successive curtains even at maximum operating rates. Also PIN photodiodes are available with integrally packaged linear amplifiers, which greatly reduces noise pickup. Noise pick up is a greater problem with PIN photodiodes which require more expensive amplifiers, more attention to wiring layout, etc. to reduce noise, However, PIN types may be preferred for some high speed applications.

When selecting photosensor 46 its spectral response must be considered. Preferably, the illumination wavelength should be sensed at no less than 70% of the photosensor's peak wavelength sensitivity. (This requirement can be somewhat relaxed for embodiments where the curtain is illuminated along its long axis.)

A critical aspect of apparatus 26 is the ratio of the curtain length ( i.e. its length along the line of printhead nozzles) to the aperture of photosensor 46. Ideally this ratio would be 1:1 so that passage of the curtain through the beam from source 40 would substantially fully block the beam. In general, however, a 1:1 ratio is not possible. Typically a photosensor aperture will be on the order of 1 millimeter while a typical printhead will elect a curtain that is substantially longer than that. Further array 16 will normally comprise two or more printheads.

Preferably the interior surfaces of apparatus 26 will be made non-reflective by an appropriate coating, or in any other convenient manner to improve the sensitivity of apparatus 26.

Figure 2:
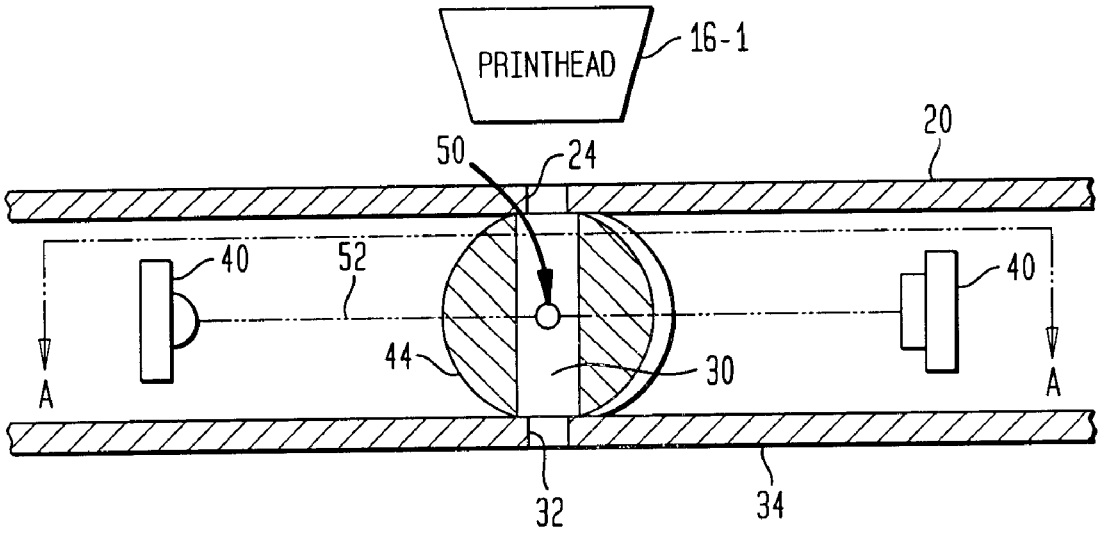
FIG. 2 is a schematic cross-sectional representation, partly broken away, showing the sensing geometry used to detect passage of a ink jet curtain in a preferred embodiment of the subject invention.
Figure 3:
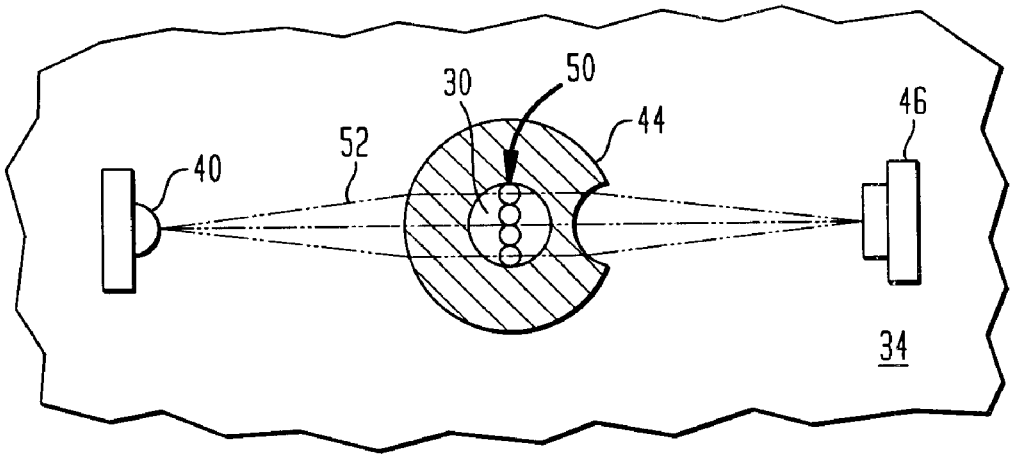
FIG. 3 is a cross-sectional schematic view along line A—A of FIG. 2.

Turning to FIGS. 2 and 3, a sensing geometry in accordance with a preferred embodiment of the subject invention is shown. In FIGS. 2 and 3 curtain 50 passes through gap 30 with its length oriented transversely to beam 52. Beam 52 diverges from source 40 and is optically collimated by a lens system before passing through gap 30 and is then focused on the aperture of photosensor 46 by the lens system. As is best seen in FIG. 3, the lens system is preferably formed integrally with dust ring 44 by appropriate modification of its cross-section. Such a design of dust ring 44 would be within the skill of a person skilled in the optical arts and need not be discussed further here for an understanding of the subject invention. In other embodiments (not shown) a separate conventional lens system can be provided to collimate and focus beam 52.

Figure 4:
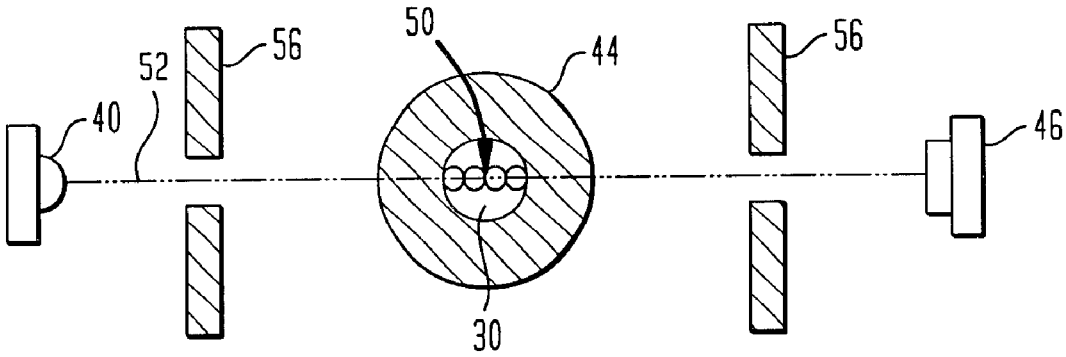
FIG. 4 is a cross-sectional schematic view, similar to FIG. 3, showing the sensing geometry used to detect passage of a ink jet curtain in another preferred embodiment of the subject invention.

In FIG. 4 a sensing geometry for another embodiment of the subject invention is shown. Here curtain 50 is oriented with its length substantially parallel with beam 52. Masks 56 limit the cross-section of beam 52 and the aperture of photosensor 46 to a diameter slightly greater than the cross-section of curtain 50. This geometry is advantageous in that viewing curtain 50 along its length greatly increases its effective optical density; reducing the required sensitivity of photosensor 46 and permitting the use of simple, inexpensive and relatively low noise phototransistor circuitry. Care must be taken in this embodiment to assure accurate alignment of all components and it should noted that this embodiment has reduced ability to detect failure of a small number of nozzles.

Figure 5:
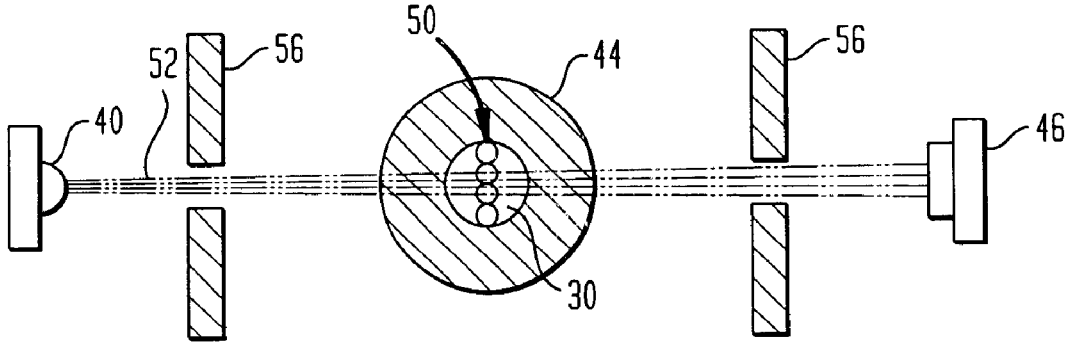
FIG. 5 is a cross-sectional schematic view, similar to FIG. 3, showing the sensing geometry used to detect passage of a ink jet curtain in another preferred embodiment of the subject invention.

In FIG. 5 a sensing geometry for another embodiment of the subject invention is shown. Here curtain 50 is again oriented with its length substantially transverse to beam 52. Masks 58 limit the cross-section of beam 52 so that it is approximately equal to the aperture of photosensor 46 and illuminates a selected portion of curtain 50. This embodiment is relatively simple and straightforward and can satisfactorily detect failure of a limited number of critical nozzles, such as those which print the postal amount. It does not, however, detect failure of unselected nozzles.

Figure 6:
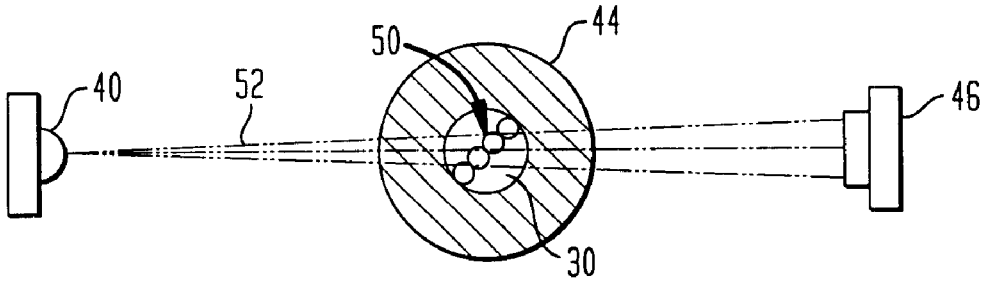
FIG. 6 is a cross-sectional schematic view, similar to FIG. 3, showing the sensing geometry used to detect passage of a ink jet curtain in another preferred embodiment of the subject invention.

In FIG. 6 a sensing geometry for another embodiment of the subject invention is shown. Here curtain 50 is oriented with its length at an angle to beam 52 such that the foreshortened image of curtain 50 is approximately equal to the aperture of photosensor 46. This embodiment is believed to be generally satisfactory provided care is taken to assure accurate alignment of all components.

Figure 7:
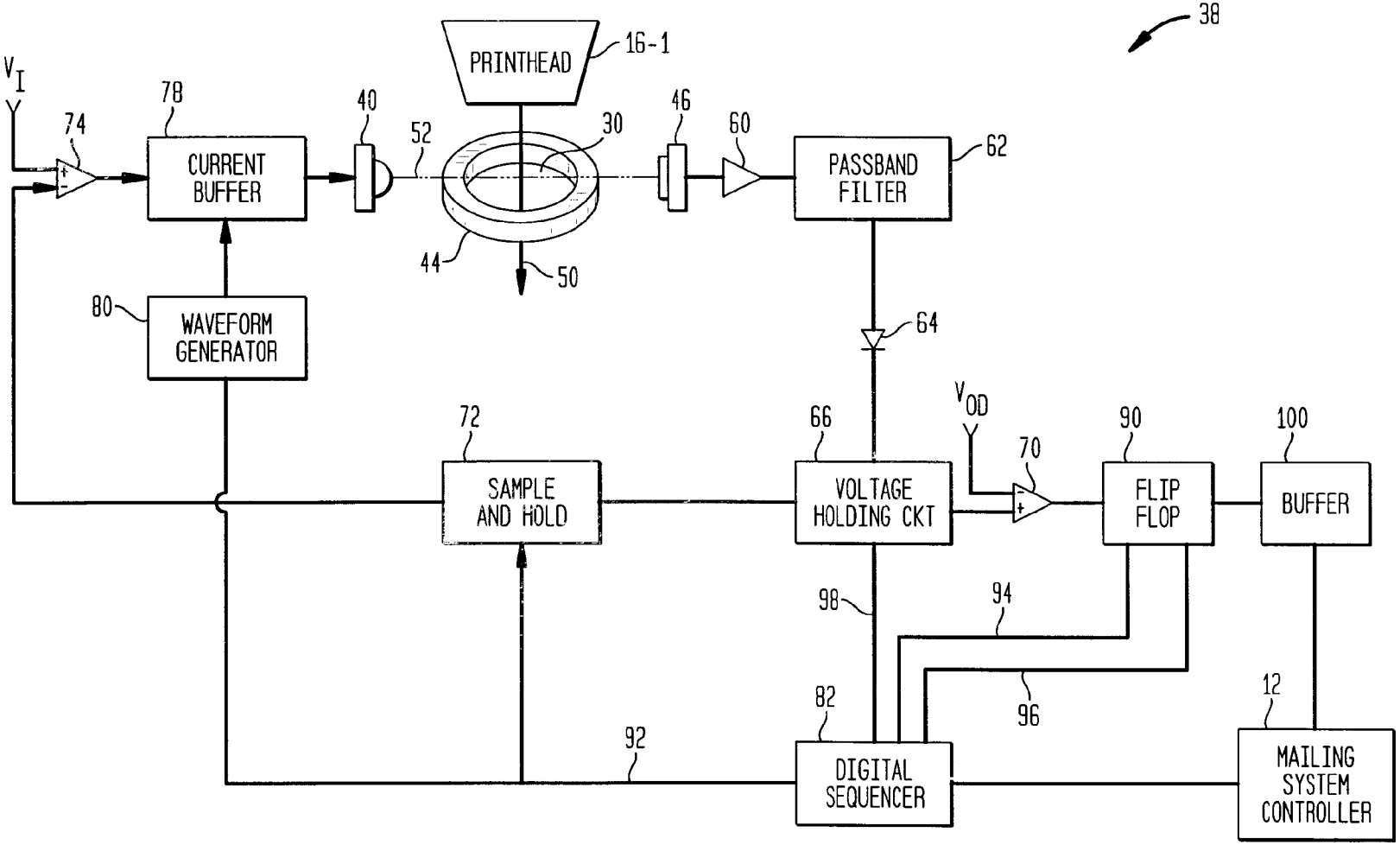
FIG. 7 is a more detailed schematic block diagram of the control electronics of the apparatus of FIG. 1.

Turning to FIG. 7, a more detailed representation of control electronics 38 is shown. In a measurement mode for determining print quality, printhead 16-1 is controlled by print controller 14(shown in FIG. 1) to eject a periodic sequence of ink jet curtains at predetermined frequency and preferable with a duty cycle of approximately 50%. (It should be noted that the description set forth below is given in relation to a single printhead for simplicity of description. Longer arrays of printheads can readily be accommodated by simply extending apparatus 26 to accommodate longer curtains or providing separate apparatus 26 for each printhead.) The sequence of curtains 50 passes through dust ring 44 and intercepts and modulates beam 52 from source 40. Modulated beam 52 is detected by photosensor 46 whose output thus varies proportionately with variations in optical density in gap 30 produced by passage of the sequence of curtains 50. (While the sensing geometry of FIG. 7 is preferably that of FIGS. 2 and 3 those skilled in the art will recognize that other geometries described above can be used without substantial modification to electronics 38,)

The output of photosensor 46 is AC coupled to, and amplified by amplifier 60, filtered by pass band filter 62, whose center frequency is selected to be equal to the frequency of the sequence of curtains 50, to improve the signal to noise ratio, and rectified by rectifier 64 to generate a DC signal representative of the optical density of curtains 50. (In embodiments of the subject invention using the sensing geometry of FIG. 4 where the length of curtains 50 is oriented parallel to beam 52 and a low noise phototransistor for photosensor 46 the signal to noise ratio of the output of photosensor 46 may be great enough that filter 62 can be omitted.)

The optical density signal from rectifier 64 is input to voltage holding circuit 66 whose output tracks the maximum value of the optical density signal. The output of voltage holding circuit 66 is input to voltage comparator 70 and to sample and hold circuit 72. The output of sample and hold circuit 72 is input to differential amplifier 74 which provides an output proportional to the difference between the output of mode control 66 and a reference voltage V(I). The output of amplifier 74 drives illumination source 40 through current buffer 78; thus establishing feedback control of the nominal intensity of beam 52.

During a measuring period in which apparatus 26 determines the optical density of curtains 50 sample and hold 72 holds its output equal to the value of the output of voltage holding circuit 66 at the beginning of the measuring period. During a calibration period, in which no curtains 50 pass through gap 30, sample and hold circuit 72 connects its output directly to the output of voltage holding circuit 66. Also during the calibration period wave form generator 80 is operational to modulate the output of current buffer 78 to simulate passage of curtains 50, as will be described further below.

Comparator 70 provides a binary output which is asserted when the output of voltage holding circuit 66 is greater than reference voltage V(OD). At the end of the measuring period, i.e. when the last of the sequence of curtains 50 has passed through gap 30, the output of comparator 70 is stored in flip-flop 90 and then transmitted to system controller 12 as a printhead malfunction signal indicative of curtains 50 having insufficient optical density, i.e. one or more nozzles of printhead 16-1's failing to eject sufficient ink.

Figure 8:
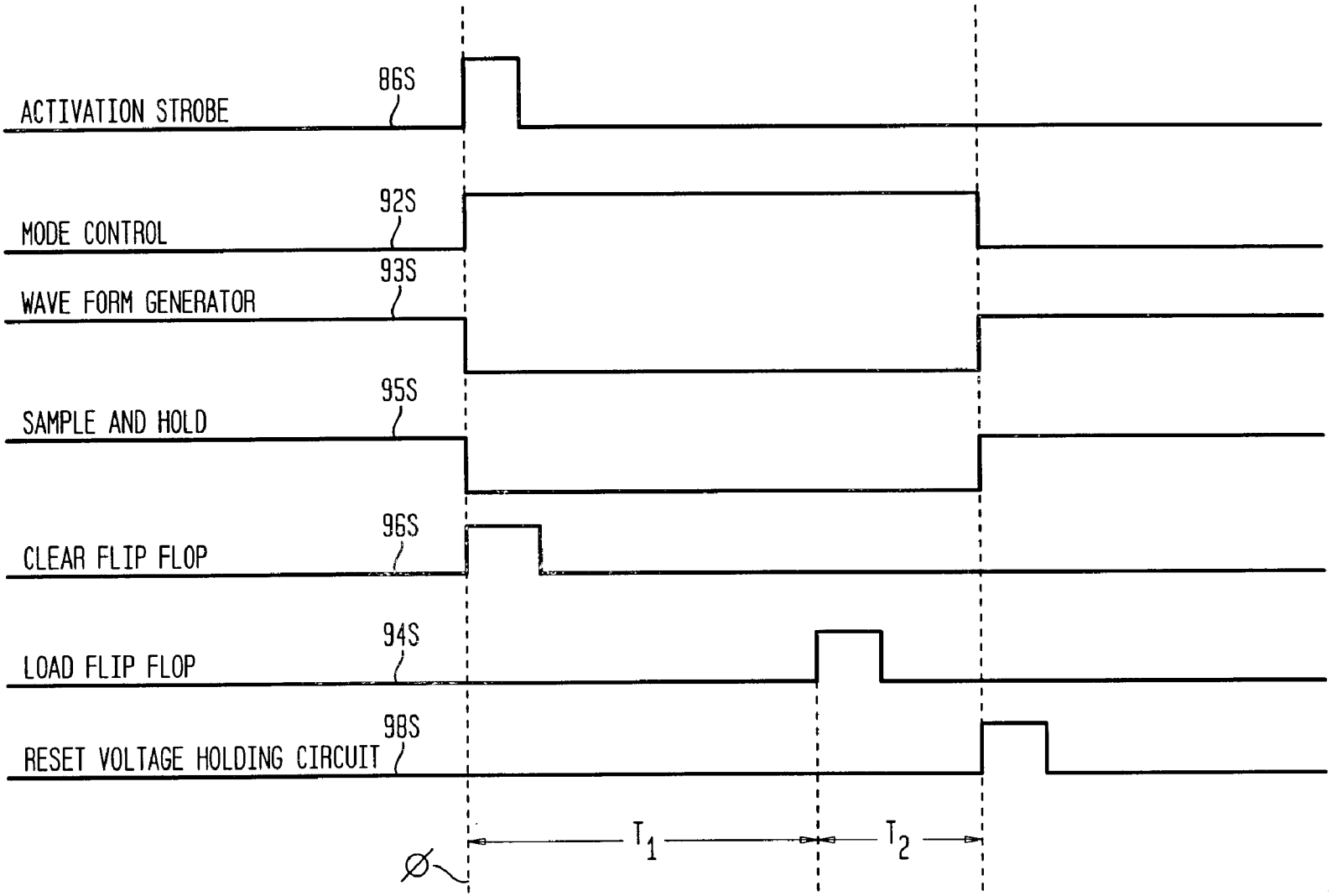
FIG. 8 is a timing diagram of the operation of the apparatus of FIG. 1.

The operation of apparatus 26 is controlled by digital sequencer 82 an can best be understood by consideration of the timing chart of FIG. 8 together with FIG. 7. Initially apparatus 26 is in calibration mode with no ink jet curtains 50 passing through gap 30. Digital sequencer 82 is in a quiescent state and all of its outputs: 92S, 94S, 96S, and 98S (shown in FIG. 8); on corresponding lines: 92, 94, 96, and 98 are quiescent. State 93S (shown in FIG. 8) of wave form generator 80 is active and generator 80 modulates current buffer 78 to cause to vary the light output of LED 40 to approximate the variations of light intensity reaching photosensor 46 caused by passage of ink jet curtains 50 through gap 30. State 95S ( shown in FIG. 8) of sample and hold circuit 72 is sampling and circuit 72 continuously samples the output of voltage holding circuit 66 and outputs it to the inverting input of amplifier 74, which is a voltage controlled current source whose out put drives LED 40 through current buffer 78 to establish a feedback loop to compensate for inherent physical variables which affect the signal input to voltage holding circuit 66 ( e.g. dust build up on ring 44); as will be described further below.

When mailing system controller 12 wishes to test printhead 16-1 it commands print controller 14 (shown in FIG. 1) to control printhead 16-1 to eject a periodic sequence of curtains 50 as described above. Concurrently, at time 0 of a measurement cycle, controller 12 asserts activation strobe 86S. In response sequencer 82 asserts mode signal 92S on line 92 to switch state 95S of sample and hold circuit 72 to hold mode, and to switch state 93S of waveform generator 80 to inactive; which fixes beam 52, the light output of LED 40, during the measurement cycle. At the same time digital sequencer 82 asserts clear strobe 96S on line 96 to clear flip-flop 90.

As successive, periodic ink drop curtains 50 modulate beam 52, voltage holding circuit 66 is operative to capture and hold the peak level of the cycling signal, representative of the optical density of curtains 50, which is generated by photosensor 46, amplified by amplifier 60, preferably filter by pass band filter 62, and rectified by rectifier 64. Holding circuit 66 outputs the resulting level to the positive input of comparator 70, If curtains 50 are not sufficiently opaque this signal will exceed reference voltage V(od) which is applied to the inverting input of comparator 70; causing the output of comparator 70 to be asserted. After a time T1, sequencer 82 will assert load strobe 94S on line 94 to load the output of comparator 70 into flip-flop 90. (The length of time T1 can be determined by simple experimentation to determine the number of ink drop curtains 50 which must intersect the light output by LED 40 to the optical density signal input to circuit 66 to reach a steady state representative of the optical density of curtains 50.) Controller 12 reads the output of flip-flop 90 through buffer 100 in a conventional manner, at a convenient time after time T1 has elapsed. Also at a convenient time after time T1 has elapsed, print controller 14 will stop production of curtains 50. (Note that these times are not critical and controllers 12 and 14 will preferably operate open loop and carry out these steps after allowing a margin of safety for time T1 to elapse.) After a non-critical time period T2 has elapsed after time T1 sequencer 82 will assert reset strobe 98S on line 98 to reset voltage holding circuit 66 and deactivate mode control signal 92S to cause sample and hold circuit 72 and wave form generator 80 to return to calibration mode.

In calibration mode the nominal intensity of beam 52 is controlled to compensate for variations in the overall sensitivity of apparatus 26. If, for example because dust has built up on the inside of dust ring 44 or because a less sensitive photosensor has been installed, the sensitivity of apparatus 26 is reduced, the feedback loop through amplifier 74 will cause the nominal intensity LED 40's output to increase until the output of voltage holding circuit equals reference voltage V(I), as shown in FIG. 8. Similarly, if the sensitivity has been increased the nominal beam intensity will be decreased. However, because the output of photosensor 46 is AC coupled through amplifier 60 to generate the optical density signal input to voltage holding circuit 66 it is necessary to simulate passage of curtains 50 during the calibration period. This is done by waveform generator 80 which subtracts a triangular or half-wave sinusoid signal, having a frequency and duty cycle selected to simulate passage of a sequence of curtains through gap 50, from the drive current output of current buffer 78, as shown in FIG. 8. (In embodiments where pass band filtering is not needed waveform generator can generate a simple square-wave signal to simulate curtains 50.)

Reference voltage V(I) is established by simple experimentation well within the ability of those skilled in the art. In the embodiments described above reference voltage V(OD) is also established by such experimentation.

In other embodiments reference voltage V(OD) can be replaced by a pair of reference voltages defining a threshold band having a substantial range between values of the optical density signal which are clearly acceptable and those which are clearly unacceptable. When values of the optical density signal in the threshold band are detected system controller 12 causes a test pattern to be printed for inspection by an operator. Depending upon acceptance or nonacceptance of the test pattern operation of mailing system 10 will continue or not. In a preferred embodiment the pair of reference levels are adjusted in response to acceptance of the test pattern to classify a greater portion of optical density signals as acceptable; and to nonacceptance to classify a greater portion of optical density signals as unacceptable. Preferably, either adjustment will also reduce the range of the threshold band. In another preferred embodiment the test pattern includes encrypted or scrambled information, unknown to the operator, which can only be perceived if the test pattern is sufficiently clear. A more detailed description of such threshold bands is set forth in commonly assigned, co-pending U.S. patent application Ser. No. 09/193,608, titled APPARATUS AND METHOD FOR REAL-TIME MEASUREMENT OF DIGITAL PRINT QUALITY, by K. Minckler, filed on Nov. 17, 1998.

The embodiments described above and illustrated in the attached drawings have been given by way of example and illustration only. From the teachings of the present application those skilled in the art will readily recognize numerous other embodiments in accordance with the subject invention. Accordingly, limitations on the subject invention are to be found only in the claims set forth below.

What is claimed is:

1. A method for monitoring operation of an ink jet printing mechanism including a plurality of print nozzles, the method comprising the steps of:

a) providing predetermined control signals to the ink jet printing mechanism, the printing mechanism responding to the control signals to actuate a continuous row of the plurality of print nozzles so as to eject a curtain of ink drops through a predetermined gap;

b) providing a source of illumination for projecting a beam through the gap at substantially a right angle to the path of the curtain, whereby the intensity of the beam downstream from the gap is reduced proportionally to the curtain's optical density;

c) sensing the beam downstream from the gap to generate an optical density signal representative of variation in intensity of the beam, whereby the optical density signal is representative of the optical density of the curtain;

d) comparing the optical density signal to a first reference signal; and e) if the comparison indicates that the curtain is insufficiently dense, generating a printhead malfunction signal.

2. A method as described in claim 1 wherein the printing mechanism is comprised in a postage metering system and is further controlled to print postal indicia where the curtain is not used to print postal indicia.

3. A method as described in claim 2 wherein the postage metering system is responsive to the printhead malfunction signal to inhibit further printing of postal indicia.

4. A method as described in claim 1 wherein the curtain is oriented so that its long axis is at approximately a right angle to the beam.

5. A method as described in claim 1 comprising the further steps of:

a) optically altering the beam to form a collimated beam in the gap; and b) focusing the collimated beam onto an aperture of a photosensor to generate the signal.

6. A method as described in claim 5 comprising the further step of:

a) substantially surrounding the gap with a transparent dust ring having openings for entry and exit of the curtain, the beam passing through the dust ring as it enters and exits the gap.

7. A method as described in claim 6 comprising the further step of:

a) shaping the surface of the dust ring to carry out the optical altering and focusing steps.

8. A method as described in claim 1 wherein the curtain is oriented with respect to the beam so that a foreshortened projection of the curtain substantially coincides with an aperture of a photosensor.

9. A method as described in claim 1 wherein the beam is masked so that the masked beam substantially coincides with an aperture of a photosensor.

10. A method as described in claim 1 wherein the curtain is oriented so that its long axis is at approximately parallel to the beam.

11. A method as described in claim 1 comprising the further steps of:

a) during a calibration period, in which no curtains pass through the gap, electronically varying the beam's intensity to artificially generate the optical density signal; and b) feeding the optical density signal back to the illumination source to control the beam's nominal intensity; whereby c) the nominal intensity is varied to compensate for variations in overall sensitivity.

12. A method as described in claim 11 wherein, during measuring periods in which the curtains pass through the gap, the nominal intensity is fixed.

13. A method as described in claim 1, the method further comprising the steps of:

providing the curtain of ink drops as one of a plurality of curtains of ink drops that are ejected in a periodic sequence so that the intensity of the beam downstream from the gap is periodically reduced proportionally to the optical density of the plurality of curtains, respectively; and generating the optical density signal by rectifying individual optical density signals corresponding to each of the plurality of curtains of ink drops.

14. A method as described in claim 13 comprising the further step of filtering the optical density signal with a pass band filter having a frequency corresponding to the period of the plurality of curtains.

15. An apparatus for monitoring operation of an ink jet printing mechanism including a plurality of print nozzles, the apparatus comprising:

a) a controller controlling the ink jet printing mechanism to actuate a continuous row of the plurality of print nozzles so as to eject a curtain of ink drops through a predetermined gap;

b) an illumination source projecting a beam through the gap at substantially a right angle to the path of the curtain, whereby the intensity of the beam downstream from the gap is reduced proportionally to the optical density of the curtain;

c) a photosensor sensing the beam downstream from the gap to generate an output proportional to variation in intensity of the beam, whereby the output is representative of the optical density of the curtain; and d) a circuit for deriving an optical density signal from the output and for comparing the optical density signal to a first reference signal and, if the comparison indicates that the curtain is insufficiently opaque, generating an printhead malfunction signal indicative of malfunction of the print mechanism.

16. An apparatus as described in claim 15 wherein the print mechanism is comprised in a postage metering system and is further controlled to print postal indicia and the curtain is not used to print postal indicia.

17. An apparatus as described in claim 2 wherein the postage metering system is responsive to the signal to inhibit further printing of postal indicia.

18. An apparatus as described in claim 15 wherein the curtain is oriented so that its long axis is at approximately a right angle to the beam.

19. An apparatus as described in claim 15 further comprising a lens system for optically altering the beam to form a collimated beam in the gap and for focusing the collimated beam onto an aperture of the photosensor to generate the signal.

20. An apparatus as described in claim 19 further comprising a transparent du st ring having openings for entry and exit of the curtain and substantially surrounding the gap the beam passing through the dust ring as it enters and exits the gap.

21. An apparatus as described in claim 20 where in the lens system is comprised in the dust ring.

22. An apparatus as described in claim 15 wherein the curtain is oriented with respect to the beam so that a foreshortened projection of the curtain substantially coincides with an aperture of the photosensor.

23. An apparatus as described in claim 15 further comprising a mask for masking the beam so that the masked beam substantially coincides with an aperture of the photosensor.

24. An apparatus as described in claim 15 wherein the curtain is oriented so that its long axis is at approximately parallel to the beam.

25. An apparatus as described in claim 15 further comprising:

a) means for electronically varying the beam's intensity to artificially generate the optical density signal during a calibration period in which no curtains pass through the gap; and b) means for feeding the optical density signal back to the illumination source to control the beam's nominal intensity; whereby c) the nominal intensity is varied to compensate for variations in overall sensitivity of the apparatus.

26. An apparatus as described in claim 25 wherein, during measuring periods in which the curtains pass through the gap, the nominal intensity is fixed.

27. An apparatus as described in claim 15, wherein:

the curtain of ink drops is one of a plurality of curtains of ink drops that are ejected in a periodic sequence by the printing mechanism so that the intensity of the beam downstream from the gap is periodically reduced proportionally to the optical density of the plurality of curtains, respectively; and the circuit rectifies individual optical density signals corresponding to each of the plurality of curtains of ink drops to derive the optical density signal.

28. An apparatus as described in claim 27 further comprising a pass band filter having a frequency corresponding to the period of the curtains for filtering the optical density signal.

29. A method as described in claim 13 comprising the further step of continuing to provide the plurality of curtains of ink drops and monitor the operation of the print mechanism until the optical density signal reaches a steady state.

30. A method as described in claim 14 comprising the further step of continuing to provide the plurality of curtains of ink drops and monitor the operation of the print mechanism until the optical density signal reaches a steady state.

31. An apparatus as described in claim 27 wherein the controller continues to provide the plurality of curtains of ink drops and monitor the operation of the print mechanism until the optical density signal reaches a steady state.

32. An apparatus as described in claim 28 wherein the controller continues to provide the plurality of curtains of ink drops and monitor the operation of the print mechanism until the optical density signal reaches a steady state.

* * * * *